US010046591B2

(12) United States Patent
Smith

(10) Patent No.: US 10,046,591 B2
(45) Date of Patent: Aug. 14, 2018

(54) "WIDEBACK" PAMPHLET FOR EASY IDENTIFICATION ON A SHELF

(71) Applicant: Rodney I. Smith, Midland, VA (US)

(72) Inventor: Rodney I. Smith, Midland, VA (US)

( * ) Notice: Subject to any disclaimer, the term of this patent is extended or adjusted under 35 U.S.C. 154(b) by 0 days.

(21) Appl. No.: 15/619,907

(22) Filed: Jun. 12, 2017

(65) Prior Publication Data

US 2017/0326903 A1 Nov. 16, 2017

Related U.S. Application Data

(63) Continuation of application No. 15/375,372, filed on Dec. 12, 2016, now Pat. No. 9,707,798, which is a continuation of application No. 14/487,323, filed on Sep. 16, 2014.

(51) Int. Cl.

| | |
|---|---|
| ***B42D 7/00*** | (2006.01) |
| ***B42F 21/04*** | (2006.01) |
| ***B42D 1/00*** | (2006.01) |

(52) U.S. Cl.
CPC ..... *B42F 21/04* (2013.01); *B42D 1/006* (2013.01); *B42D 1/007* (2013.01); *B42D 7/00* (2013.01)

(58) Field of Classification Search
CPC ..... B42D 1/006; B42D 7/00
USPC ..... 283/56; 281/20, 21.1
See application file for complete search history.

(56) References Cited

U.S. PATENT DOCUMENTS 1,470,012 A * 10/1923 Jones ..... B42D 5/002 281/18
1,786,504 A * 12/1930 Parrish ..... B42D 3/008 281/32

* cited by examiner

*Primary Examiner* — Kyle R Grabowski
(74) *Attorney, Agent, or Firm* — W&C IP

(57) ABSTRACT

A pamphlet with a plurality of pages with a placard attached to the fold line of the pamphlet at a plurality of connection points by, staples. The placard attached to the fold line can be pivoted about the fold line to a position perpendicular or parallel to the pamphlet.

6 Claims, 3 Drawing Sheets

"WIDEBACK" PAMPHLET FOR EASY IDENTIFICATION ON A SHELF

FIELD OF THE INVENTION

The present invention relates to a pamphlet made of material such as paper (or the like) with a placard attached to the fold line of the pamphlet, making it easily identifiable when positioned vertically adjacent one or more vertically oriented objects.

BACKGROUND

Information such as advertising is frequently distributed in the form of a thin pamphlet or brochure. The disadvantage of disseminating information in this way is that when such a pamphlet is filed or stored on a bookshelf, it is difficult to notice or find the pamphlet amongst other books or files occupying the same shelf because the fold line portion is thin and does not stand out for easy identification.

Attempts to develop a solution to the identification problem have already been attempted as shown in U.S. Pat. No. 2,576,783 (Pamphlet Identifying Device). The described device is placed inside a pamphlet, and portions of the device are adjusted or configured to face out towards the reader to allow for easier visual identification. Limitations of this device include the absence of a permanent connection between the device and the pamphlet. The device is placed inside the pamphlet but if the device is removed, it can be misplaced. Moreover, it is not something which a pamphlet distributor would provide. Rather, the recipient of the pamphlet uses the device on pamphlets her or she wants to save and retrieve. Ideally, the pamphlet distributor would benefit from providing a complete pamphlet with an identifier without having to rely on the recipient.

Another attempt to solve the issue of visibility of pamphlets is addressed in U.S. Pat. No. 5,575,505 (Pamphlet with Enhanced Spine). This device is T-shaped where the elongated top is the identification portion and the perpendicularly centered portion is an opening for pamphlets and the like to be inserted. The limitations of this device include the absence of a permanent connection between the device and the pamphlet. Since the device and the plurality of pamphlets that can be inserted into the device are not permanently connected, both can be separated easily. Moreover, this solution is also recipient oriented. That is, it is a device used by the recipient on pamphlets he or she wants ready access to. It is not a solution that can be provided by a pamphlet distributor for the convenience of the recipient.

Therefore, there has been a need for a pamphlet with a permanently attached identifier to facilitate recognition of the pamphlet when it is positioned with other materials on a shelf. Such a pamphlet would enable pamphlet providers to provide a pamphlet recognition feature for the convenience of the recipient.

SUMMARY

An exemplary embodiment of the present invention is to provide a thin pamphlet with an attached placard at the fold line region. The Placard is movable to a perpendicular position allowing it to be easily recognized when located on a shelf. The placard is also movable to an in-line, parallel position which is convenient for mailing and distribution purposes.

In a preferred embodiment of the invention, the pamphlet comprises a plurality of pages where the front and back of each page have a first and second section which can both contain textual or graphical information. The plurality of pages is assembled in a stacked configuration where each page is folded along a fold line between the first and second sections, allowing textual and graphical information to be viewed on any of the plurality of pages.

A placard is positioned in alignment with the line on which each page is folded. The placard has a height, width, and thickness dimensions. The width dimension of the placard is less than the total length of the first and second section of the plurality of pages. Furthermore, the width dimension ranges is preferably from 0.5 to 2 inches. The thickness dimension of the placard, preferably, is at least twice as thick as each of the plurality of pages. Alternatively or in addition, the placard may also be made of a material stiffer than each of the plurality of pages of the pamphlet. The placard preferably has a height dimension approximately equal in length to the length of the fold line.

A plurality of staples pass through the "wideback" placard and the pages of the pamphlet at or adjacent the fold line of each page in the stack. In this arrangment, the placard is moveable from a first position in alignment with the plurality of pages to a second position perpendicular to the plurality of pages by pivoting about the fold line of the pamphlet.

BRIEF DESCRIPTION OF THE DRAWINGS

The foregoing and other objects, aspects, and advantages will be better understood from the following detailed description of the preferred embodiments of the invention with reference to the drawings, in which.

DETAILED DESCRIPTION

Figure 1:
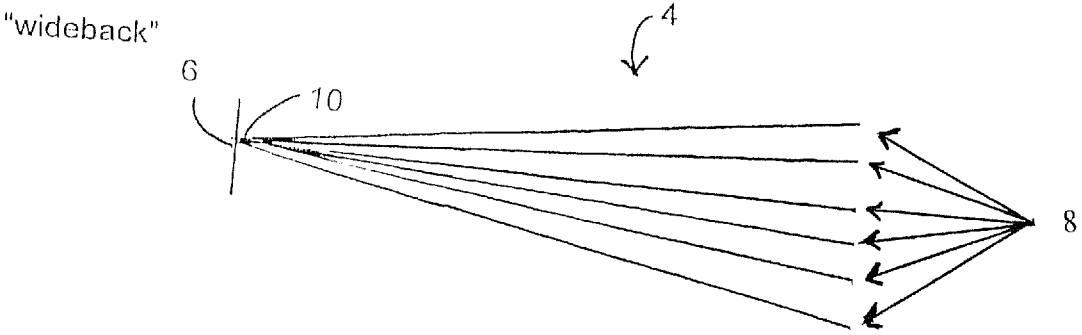
FIG. 1 is a cross-sectional side view of the pamphlet according to an embodiment of the invention.

FIG. 1 shows the pamphlet 4 has a plurality of pages 8 and has a "wideback" placard 6 attached at the center of the fold line 10 of the pamphlet 4. For illustrative purposes only, the pages are shown in a separated arrangement in FIG. 1. In use, the pages will generally be flat and be positioned one on top of another.

Figure 2:
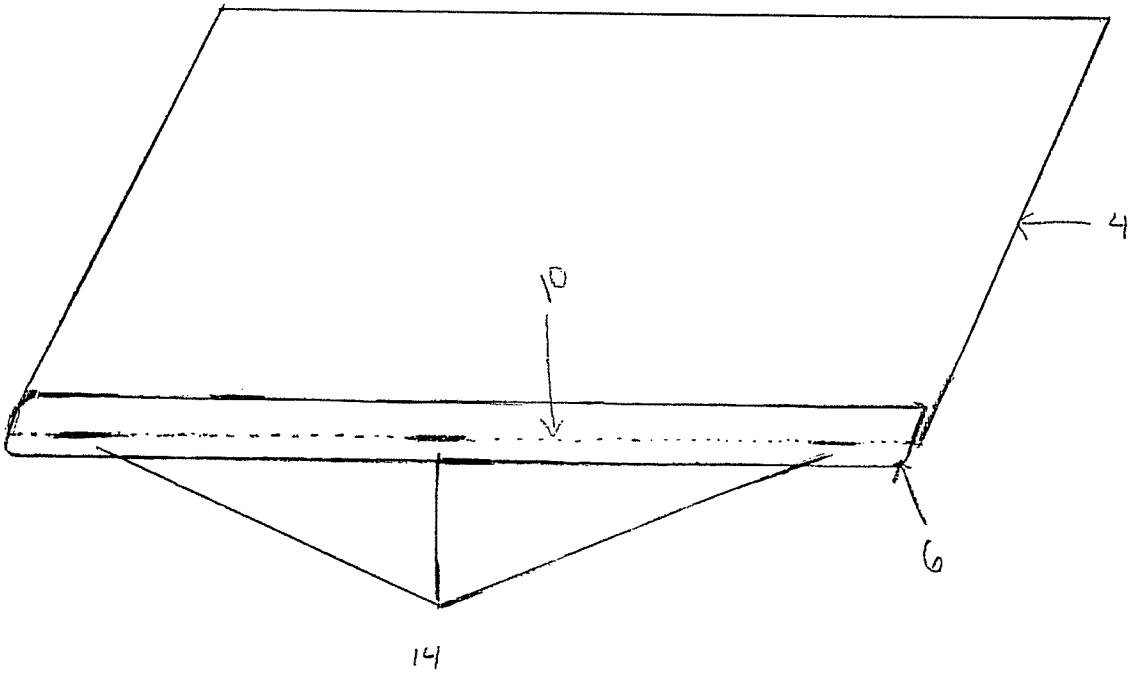
FIG. 2 is an isometric view of the pamphlet when the placard is in-line or generally parallel to the pamphlet according to an embodiment of the invention.

FIG. 2 shows an isometric view of an embodiment of the proposed invention when the placard 6 attached to the fold line of the pamphlet 10 is set parallel to the pamphlet 4. The placard 6 is attached to the fold line of the pamphlet 10 by a plurality of staples 14. The parallel arrangement allows the pamphlet to be more easily shipped and/or carried with a group of similar pamphlets to be distributed at an expo or fair.

Figure 3:
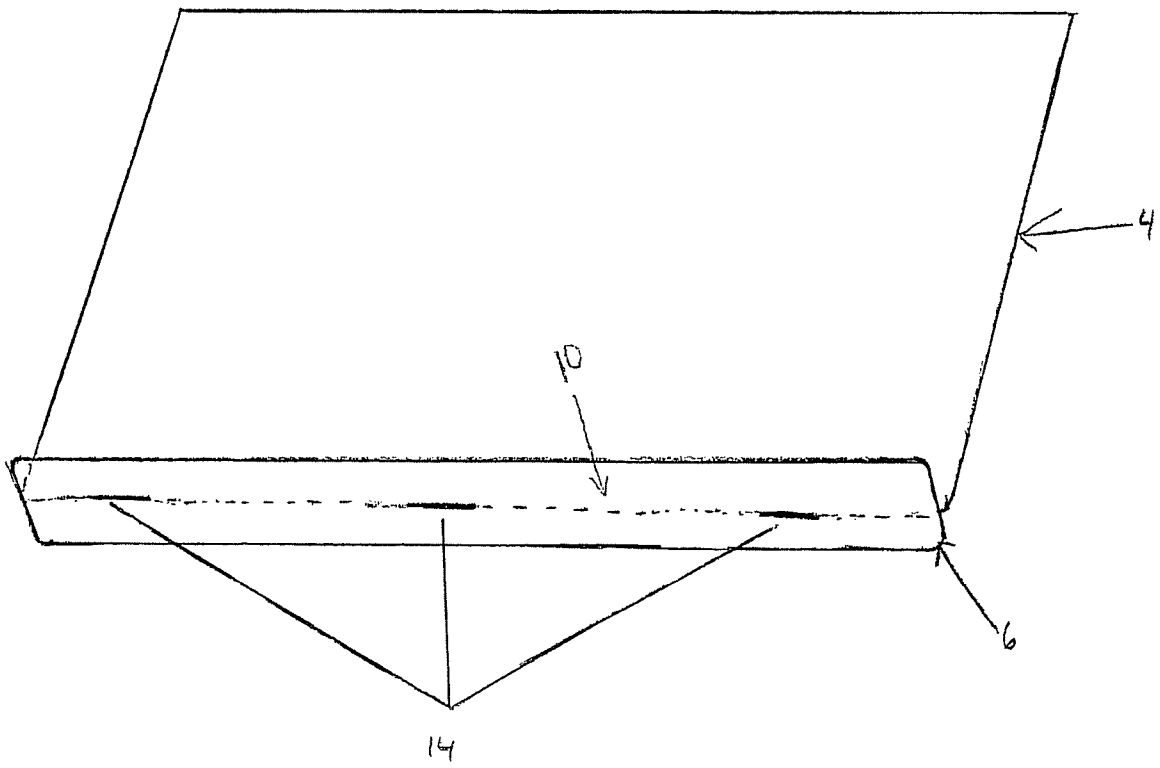
FIG. 3 is an isometric view of the pamphlet when the placard is perpendicular to the pamphlet according to an embodiment of the invention.

FIG. 3 shows an isometric view of an embodiment of the proposed invention when the placard 6 attached to the fold line of the pamphlet 10 is set perpendicular to the pamphlet 4. With reference to FIGS. 2 and 3, the placard 6 is basically pivoted about the fold line of the pamphlet 10 using the plurality of staples 14. With the placard pivoted to a perpendicular position, the pamphlet can be placed on a shelf next to other objects that are vertically oriented, and it can stand out by having the placard moved to essentially provide the pamphlet with a wide back that can be more easily seen.

Figure 4:
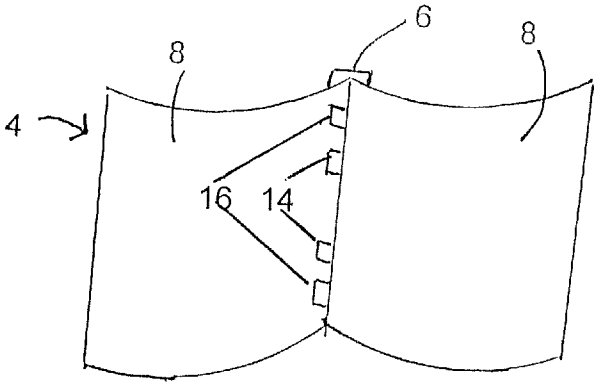
FIG. 4 is a cross-sectional front view when the pamphlet is open according to an embodiment of the invention.

FIG. 4 is a cross-sectional front view of a pamphlet 4 when it is open. When the pamphlet 8 is open, a plurality of staples can be seen. These staples could include both the plurality of staples 14 attaching the pamphlet to the placard 6 and other staples which function only for binding the plurality of pages together 16. That is, the staples binding the plurality of pages together 16 do not pass through the placard 6.

I claim:

1. A method for producing a plurality of pamphlets for distribution, wherein said pamphlets will have enhanced visibility on a shelf when positioned vertically thereon adjacent one or more vertically oriented objects, comprising:

making each pamphlet from a plurality of pages, each having front and back sides, each of said front and back sides having first and second sections on which textual or graphical information may be displayed, said plurality of pages being assembled in a stacked configuration with each page being folded along a fold line between said first and second sections, whereby said textual or graphical information on any of said plurality of pages may be viewed on either or both said first and said second sections on either or both said front and said back sides, and wherein said fold line on which each page is folded and is in alignment in said stacked configuration;

attaching a flat placard to each pamphlet on the line on which each page is folded, wherein the attaching is performed in a manner whereby the flat placard remains moveable from a first position to a second position by pivoting about the line on which each page is folded, wherein the first position of the flat placard is in alignment with said line on which each page is folded and has a first portion which extends beyond the line on which each page is folded and a second portion which extends in a direction of said pages from the line on which each page is folded, wherein the second position of the flat placard is perpendicular to the pages of the pamphlet;

orienting each of the pamphlets of the plurality of pamphlets with the placard in the first position; and assembling said plurality of pamphlets for distribution.

2. The method of claim 1 wherein said width dimension of said placard ranges from 0.5 to 2 inches.

3. The method of claim 1 wherein said height dimension of said placard is approximately equal in length to a length of said fold line.

4. The method of claim 1 wherein said placard has a stiffness or thickness which is greater than, respectively, a stiffness or thickness of each of said plurality of pages.

5. The method of claim 1 wherein the pamphlet includes one or more staples passing through said plurality of pages at said fold line which do not pass through said flat placard.

6. The method of claim 1 wherein attaching is performed with staples which pass through said flat placard and said pages, and wherein said flat placard includes a cover which covers said staples.

* * * * *